US011313162B2

(12) United States Patent
Olkay et al.

(10) Patent No.: US 11,313,162 B2
(45) Date of Patent: Apr. 26, 2022

(54) HINGE FOR DETACHABLE SHEET METAL CABINET DOORS OR WALLS

(71) Applicant: DIRAK Dieter Ramsauer Konstruktionselemente GmbH, Ennepetal (DE)

(72) Inventors: Cem Olkay, Witten (DE); Peter Höschler, Velbert (DE)

(73) Assignee: DIRAK Dieter Ramsauer Konstruktionselemente GmbH, Ennepetal (DE)

( * ) Notice: Subject to any disclaimer, the term of this patent is extended or adjusted under 35 U.S.C. 154(b) by 0 days.

(21) Appl. No.: 16/638,255

(22) PCT Filed: Aug. 2, 2018

(86) PCT No.: PCT/EP2018/070997
§ 371 (c)(1),
(2) Date: Feb. 11, 2020

(87) PCT Pub. No.: WO2019/034441
PCT Pub. Date: Feb. 21, 2019

(65) Prior Publication Data

US 2020/0165849 A1 May 28, 2020

(30) Foreign Application Priority Data

Aug. 12, 2017 (DE) ..... 20 2017 004 239.8

(51) Int. Cl.
*E05D 7/10* (2006.01)
*E05D 3/02* (2006.01)

(52) U.S. Cl.
CPC ..... *E05D 3/02* (2013.01); *E05D 7/1061* (2013.01); *E05Y 2600/632* (2013.01); *E05Y 2900/208* (2013.01)

(58) Field of Classification Search
CPC ..... E05D 7/10; E05D 7/1066; E05D 7/1061; E05D 3/02; E05D 2003/027; E05D 7/04;
(Continued)

(56) References Cited

U.S. PATENT DOCUMENTS 2,778,053 A * 1/1957 Hess ..... E05D 7/12 16/258
2,913,200 A * 11/1959 Paine, Jr. ..... F16M 5/00 248/637

(Continued)

FOREIGN PATENT DOCUMENTS

DE 202015001918 U1 7/2016
DE 202016003986 U1 * 9/2017 ..... E05D 7/1061

(Continued)

*Primary Examiner* — Emily M Morgan
(74) *Attorney, Agent, or Firm* — The Webb Law Firm

(57) ABSTRACT

The invention relates to a hinge for detachable sheet metal cabinet doors or walls, comprising a first hinge part or frame part that can be secured to the door or cabinet frame, and a second hinge part or door hinge part that can be fixed to the door leaf or cabinet wall, which hinge parts are connected to one another in an articulated manner by means of a hinge pin, and having a latch-type tongue that is arranged in the second hinge part such that it can move against a spring force, characterised by a lifting device which encompasses the hinge pin guided through finger-type ends of the first hinge part and which centrally supports the hinge pin together with a hook retained by the door part, such that the lifting device moves the encompassing part of the second hinge part perpendicular to the plane of the door leaf or cabinet wall, via actuation, by means of a key, such as a double bit key.

7 Claims, 10 Drawing Sheets

(58) Field of Classification Search
CPC ..... E05D 7/0415; E05D 7/0423; H02B 1/38; E05Y 2900/208
USPC ..... 16/267
See application file for complete search history.

(56) References Cited

U.S. PATENT DOCUMENTS

| | | | | | |
|---|---|---|---|---|---|
| 4,873,745 | A * | 10/1989 | Ramsauer | E05D 7/10 | 16/258 |
| 5,794,310 | A * | 8/1998 | Dallmann | E05D 7/0415 | 16/235 |
| 9,151,101 | B2 * | 10/2015 | Lowe | E05F 5/02 | |
| 2007/0130726 | A1 * | 6/2007 | Alfredsson | E05D 7/1066 | 16/267 |
| 2008/0115327 | A1 * | 5/2008 | Eberl | E05D 7/0407 | 16/382 |
| 2012/0005859 | A1 | 1/2012 | Herglotz et al. | | |
| 2015/0315832 | A1 * | 11/2015 | Wu | E05D 3/02 | 16/54 |
| 2016/0208533 | A1 * | 7/2016 | Ng | E05D 7/0415 | |
| 2018/0044957 | A1 * | 2/2018 | Hoschler | E05D 7/1061 | |
| 2019/0323273 | A1 * | 10/2019 | Georg | A47B 81/00 | |
| 2020/0262689 | A1 * | 8/2020 | Lee | E05D 3/02 | |
| 2020/0371561 | A1 * | 11/2020 | Lin | E05D 11/1014 | |

FOREIGN PATENT DOCUMENTS

| | | | | |
|---|---|---|---|---|
| EP | 0274549 | A1 | 7/1988 | |
| EP | 2405088 | A2 | 1/2012 | |
| WO | WO-2007033714 | A1 * | 3/2007 | E05C 9/22 |
| WO | 2012040945 | A2 | 4/2012 | |

* cited by examiner

Opening of the hinge closed

Actuator turned by 180° in clockwise direction

Actuator turned by 360° in clockwise direction

Insert key and turn through 180° in clockwise direction

Door performes a rise (pressure equalization)

Fig. 15A
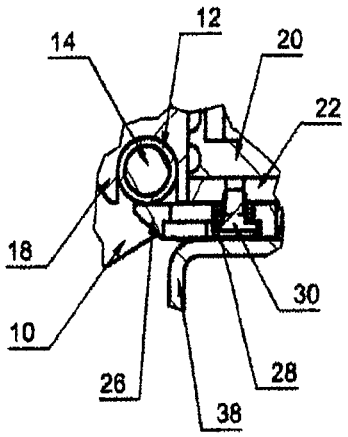
Fig. 15B
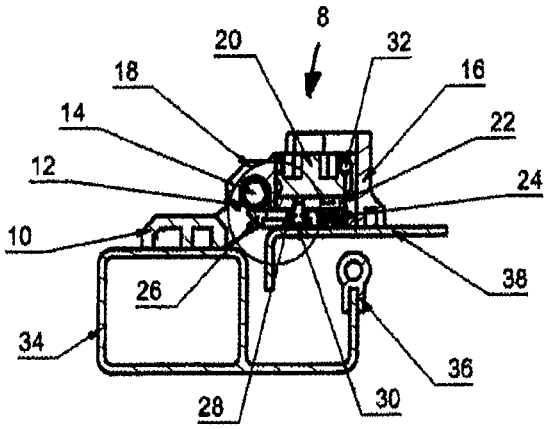
Fig. 16A
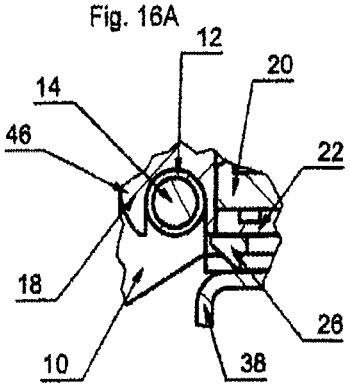
Fig. 16B
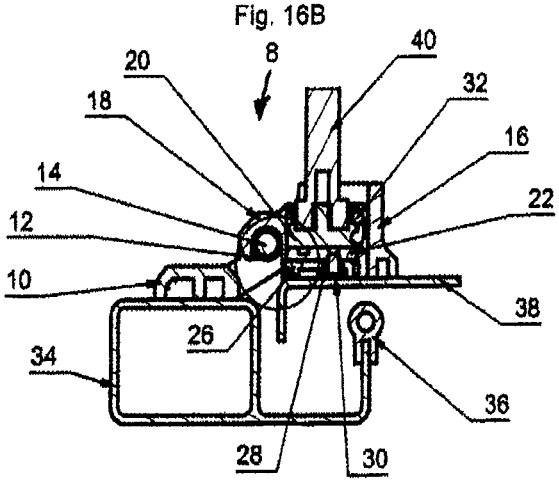
Fig. 17A
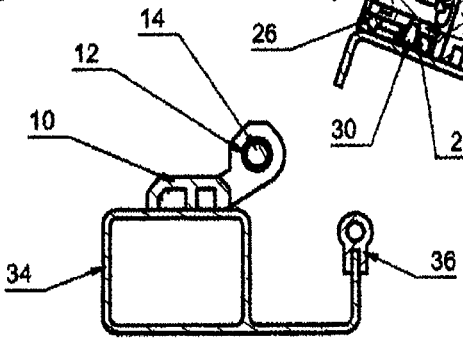
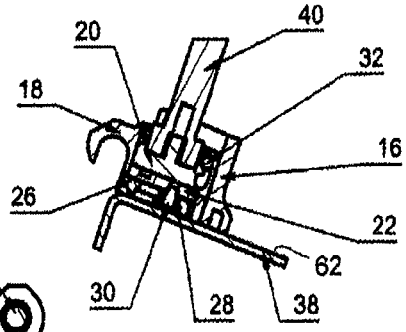
Fig. 17B

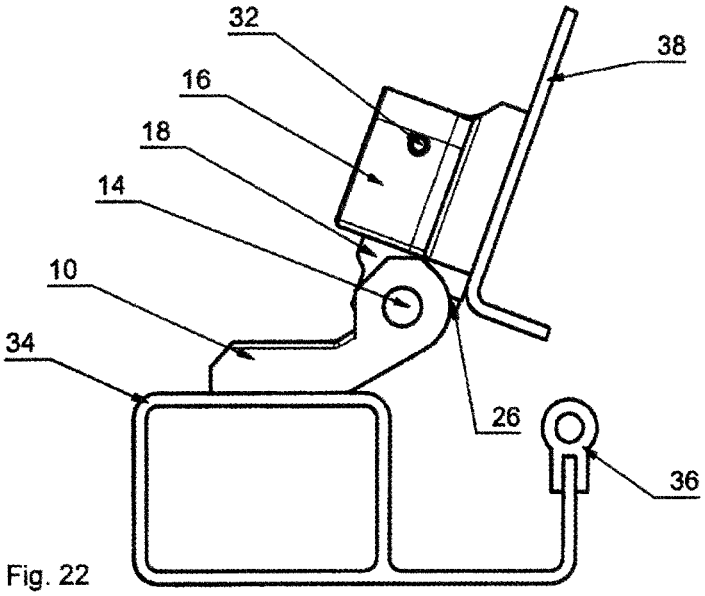
Fig. 22
Hinge function is maintained
Fig. 23
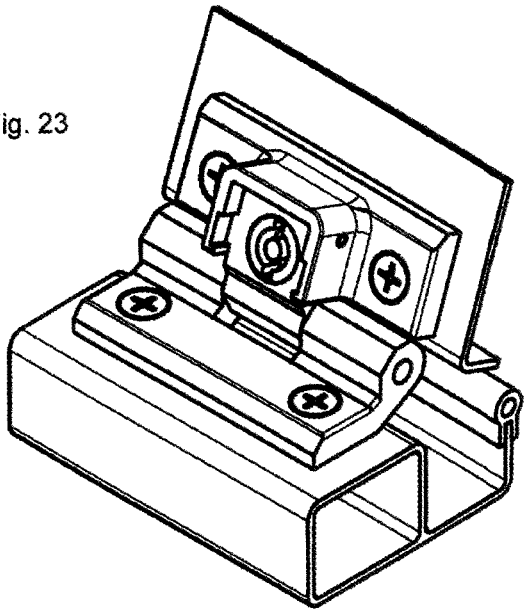

HINGE FOR DETACHABLE SHEET METAL CABINET DOORS OR WALLS

CROSS-REFERENCE TO RELATED APPLICATIONS

This application is the United States national phase of International Application No. PCT/EP2018/070997 filed Aug. 2, 2018, and claims priority to German Patent Application No. 202017004239.8 filed Aug. 12, 2017, the disclosures of which are hereby incorporated by reference in their entirety.

BACKGROUND OF THE INVENTION

Field of the Invention

The invention relates to a hinge for detachable sheet metal cabinet doors or walls, comprising a first hinge part or frame hinge part that can be attached to the door or cabinet frame and a second hinge part or door hinge part that can be fixed to the door leaf or cabinet wall, which hinge parts are connected to one another by means of a hinge pin in an articulated manner, and having a latch-type tongue that is arranged in the second hinge part such that it can move against a spring force, which encompasses the hinge pin guided through the finger-type ends of the first hinge part and centrally supports the hinge pin together with the hook formed by the second hinge part.

Description of Related Art

Such a hinge arrangement for detachable sheet metal cabinet doors or walls is already known from German utility model specification DE 20 2015 001 918 U1. This hinge and also other known hinges are suitable for combining a hinge and closing function, in order to allow provision of flexible options such as a change of hinge side and/or locking side.

The intention is to improve on the prior art such that an additional lifting and pressing function adds a further closing function to the already known hinges in a field of application.

SUMMARY OF THE INVENTION

The object is achieved in that a lifting device is provided which, by means of a key, such as a double bit key, via an actuator moves the encompassing part of the second hinge part perpendicularly to the plane of the door leaf or the cabinet wall, to which the hinge is attached or screwed.

The lifting device advantageously forms guide walls for which the external walls of the lifting device constitute a guide and encompass these in a U-shaped manner.

The external walls form feet, with which they are attached to the door leaf, so that as the external walls are raised and lowered, a raising and lowering of the door leaf or the cabinet wall is achieved.

The guide walls support a turntable provided in the foot region with a track, in which track a projection is inserted, which protrudes from the bottom of the actuator.

A head screw is screwed into the bottom of the turntable. This facilitates mounting of the arrangement. In order to be able to perform both movements, namely on the one hand the lifting of the walls and on the other hand the moving of the tongue, independently of one another, the tongue has an L-shaped cutout, through which a pin arranged in the walls is provided, which guides the tongue upon rotation of the actuator such that upon rotation through 180° in a first direction (e.g. clockwise direction or right rotation) the walls are raised, and that by rotation through a further 180° in the same direction (clockwise direction) the tongue is drawn into the guide walls.

The leg direction of the L-shape determines the movement of the tongue parallel and perpendicularly to the door leaf plane. A hinge, driven by a suitable key in a rotatable actuator accessible from the outside of the hinge, performs a lifting or pressing movement away from or towards the first hinge part, without affecting the hinge function. This is achieved by a pin that sits in the second hinge part, which engages in a curved track located on the outer periphery of the actuator thereby allowing the lifting or pressing movement. The turntable in conjunction with carrier and spacer ensures that only after the lifting movement the latch or the tongue can be retracted by a further rotational movement of the key and thus a separation of the hinge is caused and the hinge function is inhibited. The latch or the tongue is also provided with an override and has a spring force such that the closing operation can be carried out without a key.

In addition to the already known hinge and closing function the lifting and lowering function of the novel hinge allows the closing comfort at sealing pressure to be significantly increased and/or a pressure relief prior to the opening process to be ensured. This also allows a possible safety issue to be addressed at corresponding internal housing pressure or enables a compression of the seal appropriate for the class of protection.

BRIEF DESCRIPTION OF THE DRAWINGS

The invention is now explained in more detail using exemplary embodiments which are shown in the drawings.

These show as follows:

FIG. 15 A an enlarged representation of the tongue in the locking position;

FIG. 15 B a similar view to FIG. 13 representing the internal arrangement of the hinge;

FIG. 16 A a similar view to FIG. 15 A, but with the tongue retracted;

FIG. 16 B a similar view to FIG. 15 A of the state of FIG. 16 A;

FIG. 17 A and FIG. 17 B a similar view to FIG. 16 B, but with the hinge taken apart;

FIG. 22 a side view of the hinge in the hinge function; and

FIG. 23 a perspective representation of the hinge of FIG. 22.

DESCRIPTION OF THE INVENTION

Figure 1:
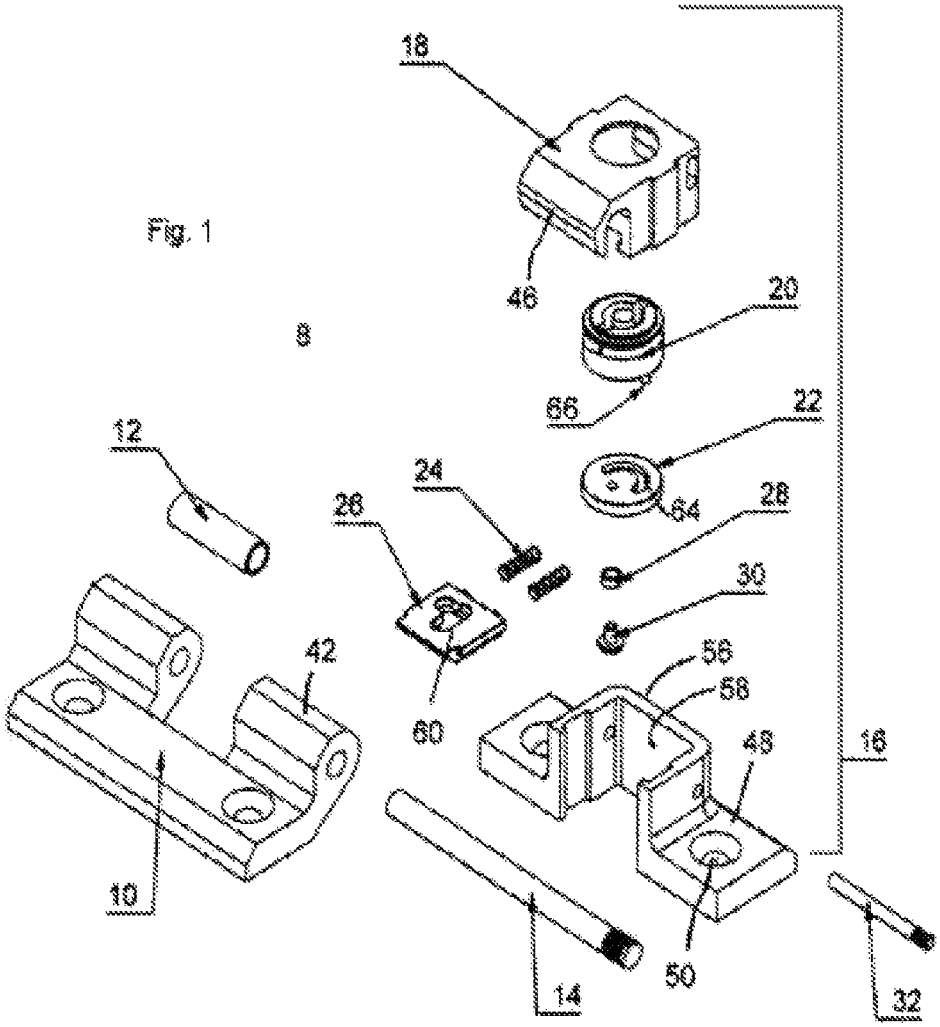
FIG. 1 the individual parts of the hinge according to the invention in exploded view.
Figure 2:
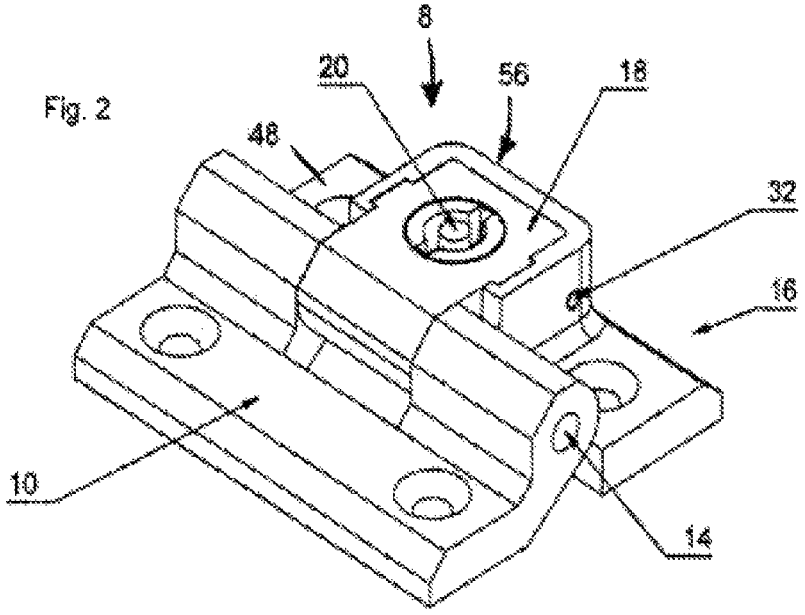
FIG. 2 the hinge in the assembled state with the individual parts of FIG. 1, wherein the hinge is in the rest position.
Figure 3:
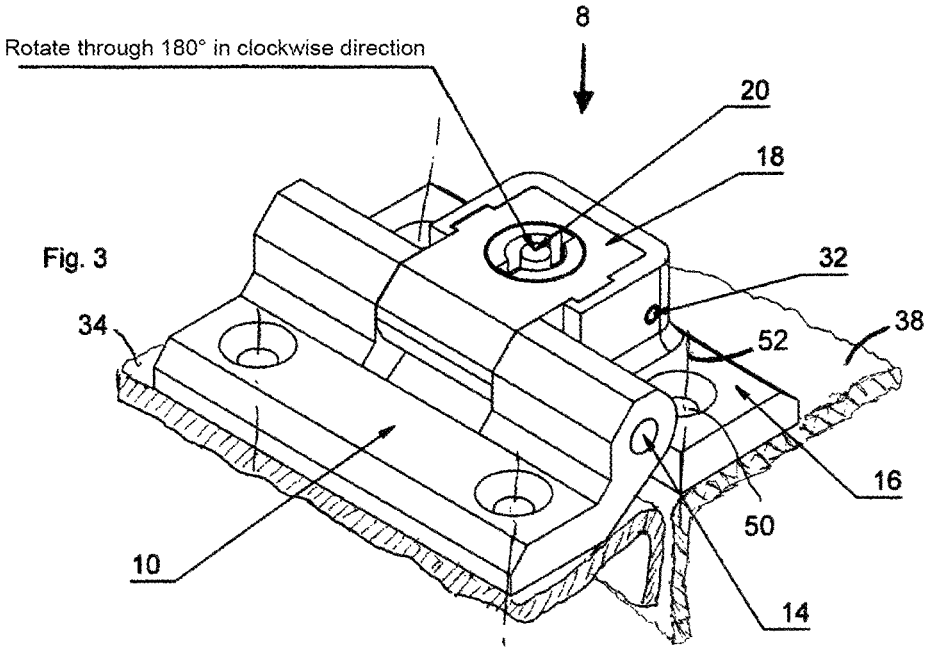
FIG. 3 the hinge after mounting in a sheet metal cabinet in the rest position, in a representation similar to FIG. 2.
Figure 4:
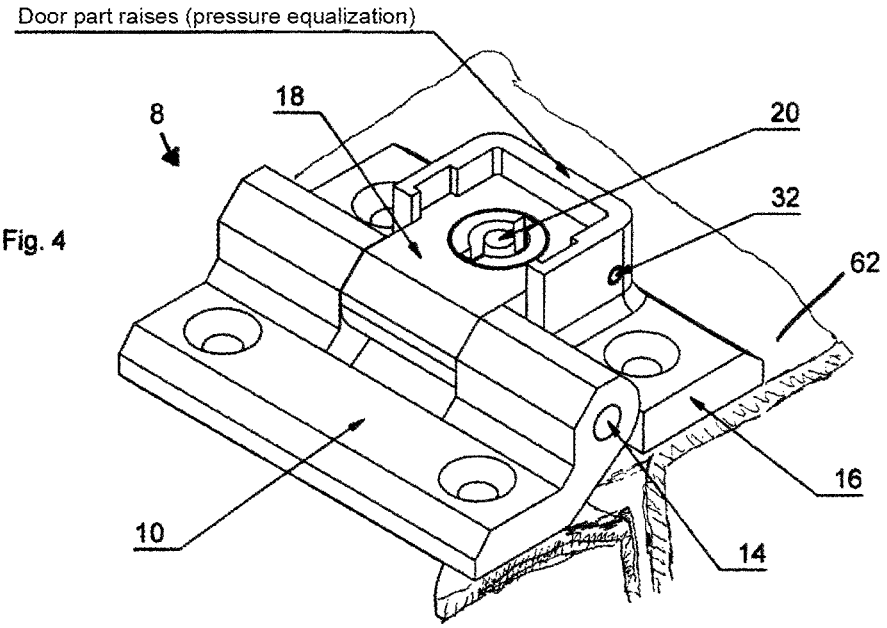
FIG. 4 the hinge with the second hinge part raised after a rotation through 180'.
Figure 5:
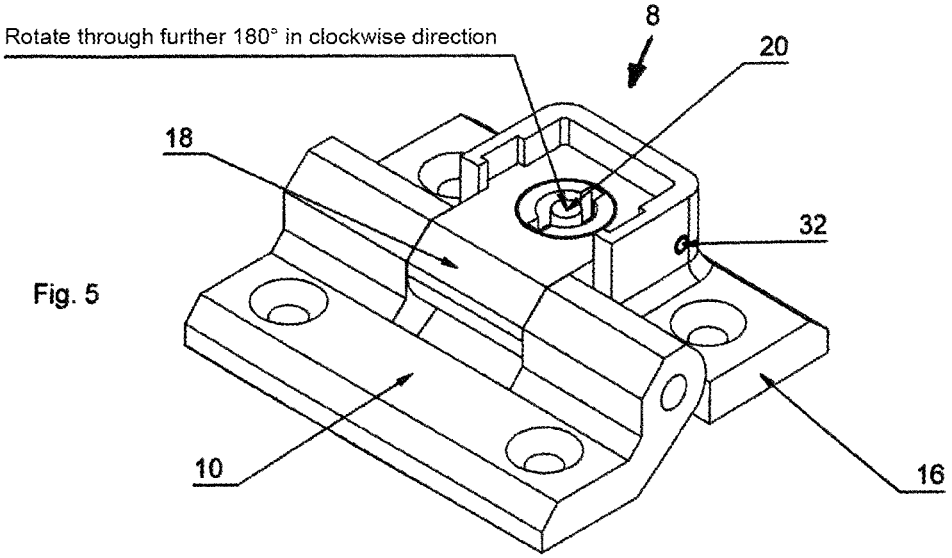
FIG. 5 a perspective view of the hinge following an initial use before the further rotation through 180° in the clockwise direction for moving out through pulling of the tongue.
Figure 6:
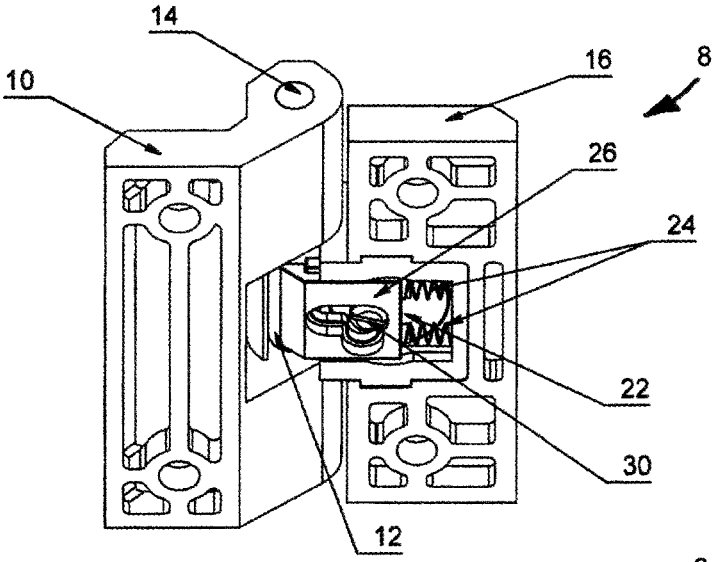
FIG. 6 the state with the tongue advanced (hinge function)
Figure 7:
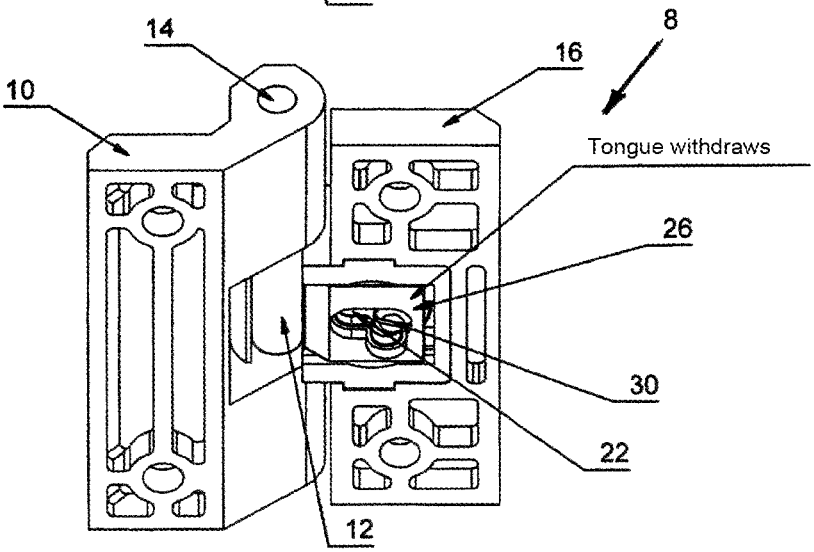
FIG. 7 the state with the tongue retracted (hinge parts can be separated)
Figure 8:
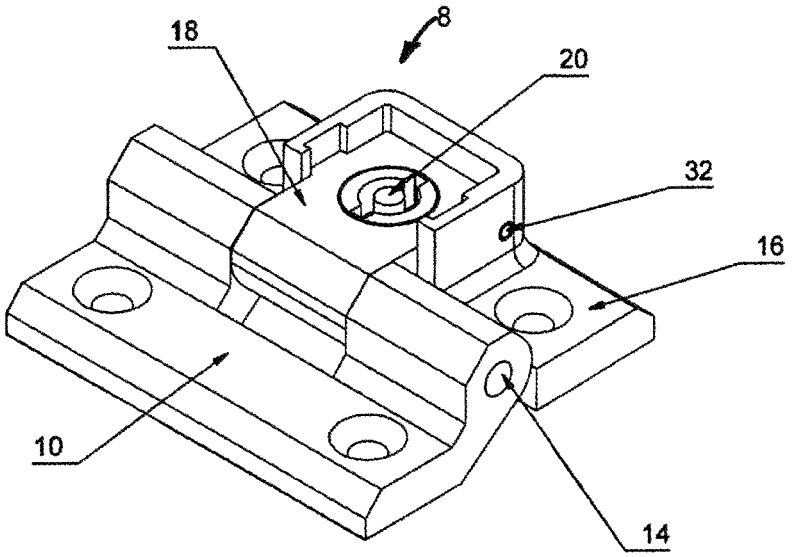
FIG. 8 a top view of the hinge according to the invention in the lowered position.
Figure 9:
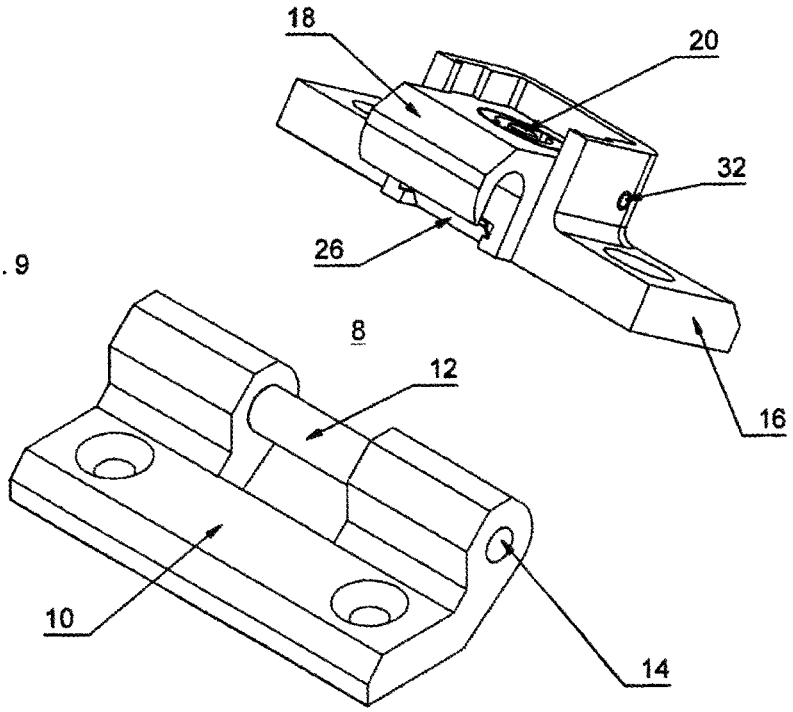
FIG. 9 the hinge of FIG. 8 following separation into the two hinge parts.

In FIG. 1 an exploded view of the hinge 8 according to the invention is illustrated, while FIG. 2 illustrates the assembled hinge 8 and FIG. 3 the hinge 8 after mounting in a door The hinge 8 according to the invention for detachable sheet metal cabinet doors or walls, comprises a first hinge part first hinge part 10 that can be attached to the door or cabinet frame 34, and a second hinge part 16 that can be fixed to the door leaf or cabinet wall 38, which hinge parts 10,16 are connected to one another in an articulated manner by a hinge pin 14 with a spacer roller 12, and having a latch-type tongue 26 that is arranged in the second hinge part 16 such that it can move against a spring force within the spring 24, a lifting device 18, which encompasses the hinge pin 14 guided through the finger-type ends 42 of the first hinge part 10 and which centrally supports the hinge pin with a hook 46 formed by the lifting device 18, the lifting device moves the encompassing part or hook of the second hinge part 16 perpendicularly to the plane 62 of the door leaf or cabinet wall 16 by means of a key 40, such as a double bit key, via an actuator 20.

The second hinge part 16 forms guide walls 58, which provide a guide for the lifting device and encompass this in a U-shaped manner. The guide walls 58 are formed by a part 56 of the second hinge part 16. The second hinge part also includes feet 48 with bore holes 50 for attaching the second hinge part 16 to the cabinet door by screws 52.

The lifting device supports the key housing 20 and the turntable 22 has a track 64 in which a projection 66 is inserted which protrudes from the bottom of the actuator 20.

Figure 10:
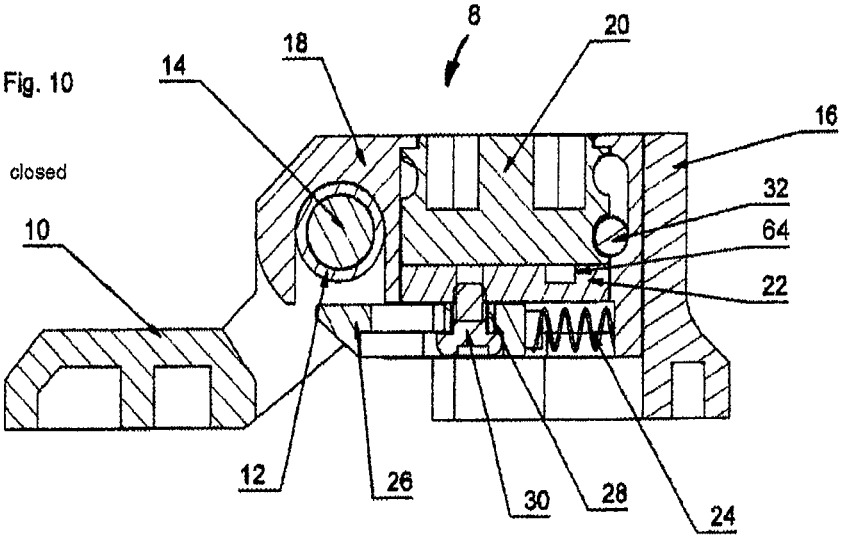
FIG. 10 a cross-sectional view of the hinge according to the invention in the closed position (hinge function)
Figure 11:
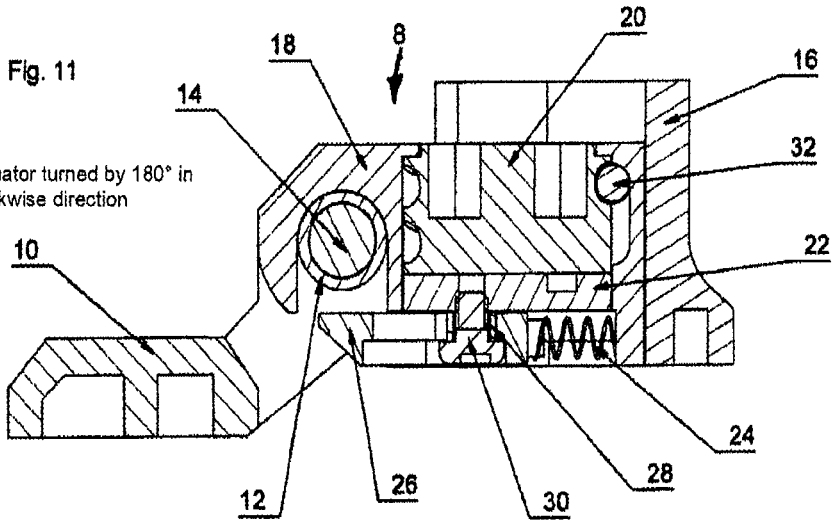
FIG. 11 a similar view to FIG. 10 in the lowered position following rotation through 180'.
Figure 12:
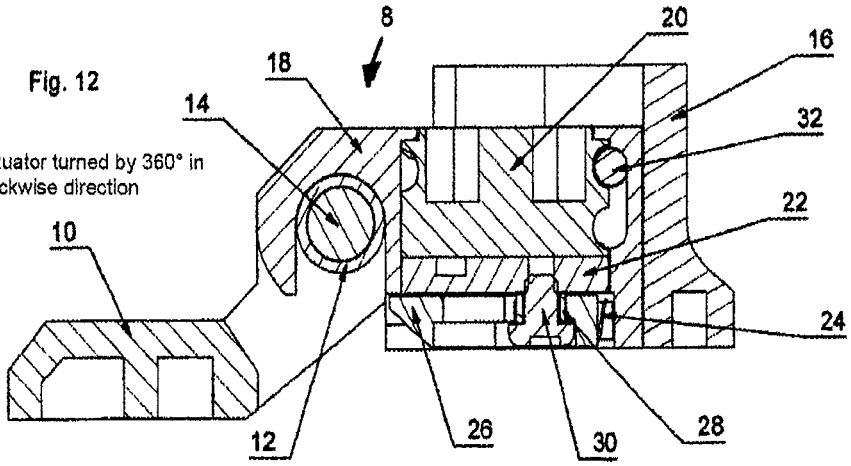
FIG. 12 the position following rotation through 360°.
Figure 13:
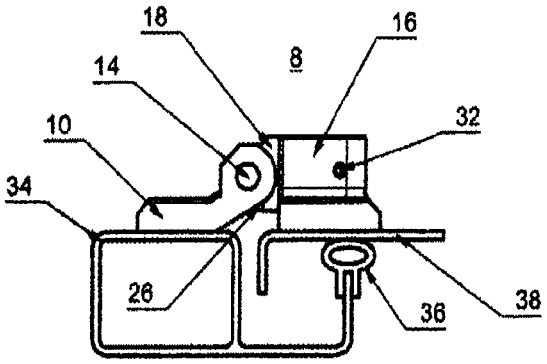
FIG. 13 a side view of the hinge mounted on the switch cabinet with seal.
Figure 14:
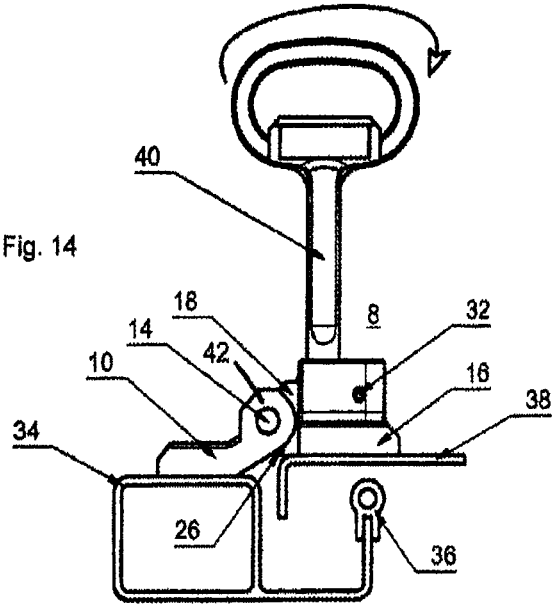
FIG. 14 the arrangement of FIG. 13 following insertion of an actuator key and clockwise rotation of this through 180° (door lifts) (pressure equalization, seal is relaxed)
Figure 18:
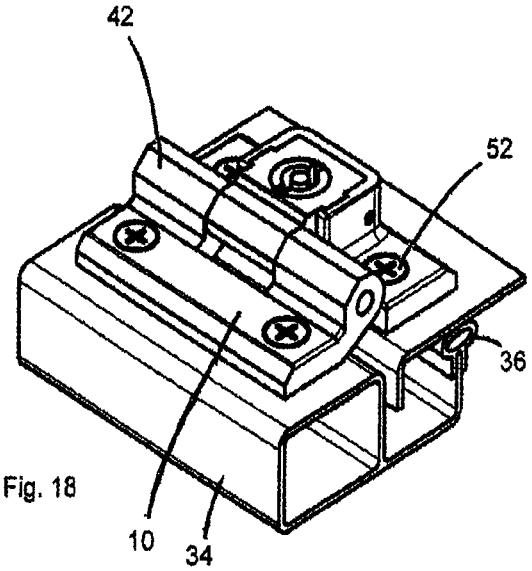
FIG. 18 a perspective view of the mounted and closed hinge.
Figure 19:
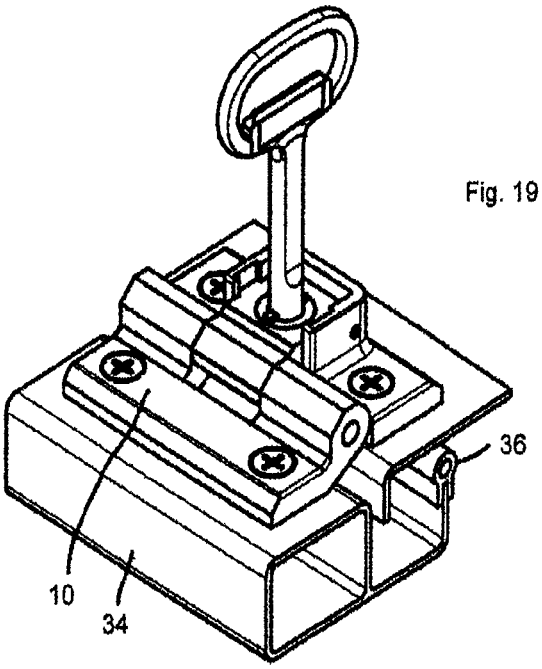
FIG. 19 a perspective view of the mounted and relaxed hinge with key inserted.
Figure 20:
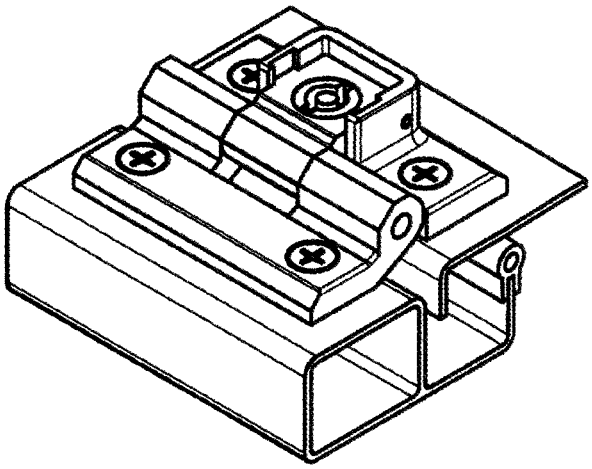
FIG. 20 the hinge in the mounted and relaxed position without key.
Figure 21:
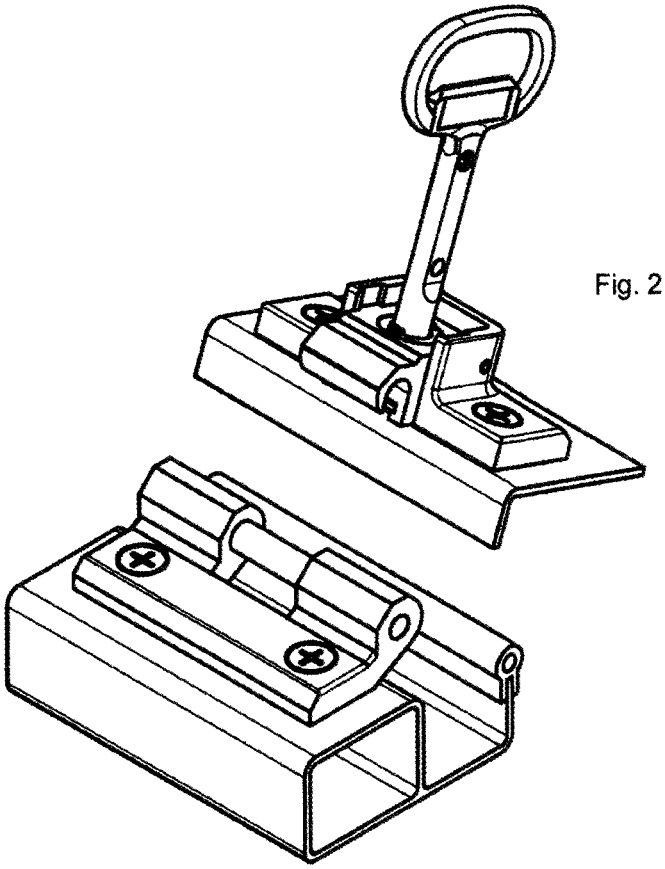
FIG. 21 the mounted hinge following separation of the hinge parts.

The projection is formed by a head screw 30, which is screwed into the bottom of the actuator. This facilitates mounting of the arrangement in its movement. In order to be able to perform both movements, namely on the one hand the lifting of the guide walls 58 and on the other hand the moving of the tongue independently of one another, the tongue 26 has an L-shaped cutout 60, which guides the tongue upon rotation of the actuator such that upon rotation through 180° in a first direction (e.g. clockwise direction or right rotation) the guide walls 58 are raised, and that by rotation through a further 180° in the same direction (clockwise direction) the tongue is drawn into the guide walls 58 (see FIGS. 10, 11, 12).

This results in a hinge 9, which driven by a suitable key 40 in a rotatable actuator 20 accessible from the outside, allows a guide wall 58 of the hinge to perform a lifting or pressing movement away from or towards the first hinge part 10, without affecting the hinge function. This is achieved by a pin 32 sitting in the second hinge part, which engages in a curved track located on the outer periphery of the actuator and thus allows the lifting or pressing movement. The turntable 22 in conjunction with carrier and spacer 28 ensures that only after the lifting movement the tongue 26 can be retracted by a further rotational movement of the key and thus a separation of the hinge is caused, and the hinge function is inhibited. The tongue is also provided with an override so that supported by a spring force the closing operation can be carried out without a key.

LIST OF REFERENCE NUMERALS

8 Hinge
10 First hinge part
12 Spacer roller
14 Hinge pin 6×80
16 Second hinge part
18 Lifting device
20 Actuator
22 Turntable
24 Spring 0.25×3.2×20.7
26 Tongue
28 Spacer
30 Screw
32 Dowel pin 3×34
34 Cabinet/door frame
36 Seal
38 Cabinet door/Door leaf
40 Double bit key
42 Finger-type ends
46 Hook
48 Feet
50 Bore hole
52 Screw
56 Part
58 Guide walls
60 L-cutout
62 Door leaf plane
64 Track
66 Projection

The invention claimed is:

1. A hinge for detachable cabinet doors, the hinge comprising:

a first hinge part attachable to the cabinet, the first hinge part having two ends each having through holes, the two ends being spaced apart and configured to receive a hinge pin therethrough and through a space between the two ends; and a second hinge part attachable to a cabinet door, the second hinge part comprising:

a tongue;

a spring biasing the tongue in a first direction;

a lifting device with a hook;

a part attachable to the cabinet door including guide walls for the lifting device; and a rotatable actuator that has an exposed drive recess;

wherein the hinge pin is configured to connect the first and second hinge parts in a rotatable manner, wherein the hinge pin is configured to be engaged in the space between the two ends by the hook and the tongue, wherein the lifting device and the part attachable to the cabinet door are configured such that the lifting device and the part attachable to the cabinet door move relative to each other in a direction perpendicular to the surface of the cabinet door, and wherein the tongue is configured to move relative to the part attachable to the cabinet door in a direction along the surface of the cabinet door.

2. The hinge according to claim 1, wherein the guide walls at least partially encompass the walls of the lifting device in a U-shaped manner.

3. The hinge according to claim 2, wherein the walls of the part attachable to the cabinet door form feet, the feet being attached to the cabinet door leaf.

4. The hinge according to claim 2, wherein the guide walls receive a turntable therein, the turntable defining a track, wherein a projection protrudes into the track of the turntable, thereby engaging the turntable with the actuator.

5. The hinge according to claim 4, wherein a head screw is screwed into the bottom of the turntable.

6. The hinge according to claim 5, wherein the actuator is configured to rotate 360°, wherein upon a first 180° rotation of the actuator in a first direction, the tongue is configured to be guided such that the walls of the second hinge part are configured to be raised in relation to the tongue, and wherein upon a second 180° rotation of the actuator in the first direction, the tongue is configured to be drawn into the guide walls.

7. The hinge according to claim 6, wherein upon the second rotation of the actuator, the tongue is configured to retract against the biasing of the spring, moving relative to the part attachable to the cabinet door, thereby permitting separation of the second hinge part from the first hinge part.

* * * * *